US007066797B2

(12) United States Patent
Volken et al.

(10) Patent No.: US 7,066,797 B2
(45) Date of Patent: Jun. 27, 2006

(54) BLOCK PIECE FOR HOLDING AN OPTICAL WORKPIECE, IN PARTICULAR A SPECTACLE LENS, FOR MACHINING THEREOF

(75) Inventors: Claude Volken, Balsthal (CH); Ueli Wyler, Langenthal (CH); Oswin Lack, Hägendorf (CH)

(73) Assignee: Satisloh AG, Baar (CH)

( * ) Notice: Subject to any disclaimer, the term of this patent is extended or adjusted under 35 U.S.C. 154(b) by 0 days.

(21) Appl. No.: 11/122,677

(22) Filed: May 5, 2005

(65) Prior Publication Data

US 2005/0250430 A1 Nov. 10, 2005

(30) Foreign Application Priority Data

May 6, 2004 (DE) ..... 10 2004 023 036

(51) Int. Cl.
*B24B 41/06* (2006.01)

(52) U.S. Cl. ..... 451/390; 451/460

(58) Field of Classification Search ..... 451/390, 451/460, 364, 384
See application file for complete search history.

(56) References Cited

U.S. PATENT DOCUMENTS 2,859,568 A * 11/1958 Dantzic ..... 451/390
3,996,701 A 12/1976 Ramirez et al.
4,158,273 A * 6/1979 Olsen et al. ..... 451/42
4,714,232 A * 12/1987 Blot ..... 249/90
5,462,475 A * 10/1995 Kennedy ..... 451/384
5,669,807 A 9/1997 Moreau et al.
5,916,017 A * 6/1999 Sedlock ..... 451/460
6,110,016 A * 8/2000 Coleman et al. ..... 451/42
6,855,042 B1 * 2/2005 Werner et al. ..... 451/390

FOREIGN PATENT DOCUMENTS

EP 1 327 496 A2 7/2003

* cited by examiner

*Primary Examiner*—Dung Van Nguyen
(74) *Attorney, Agent, or Firm*—Reising, Ethington, Barnes, Kisselle, P.C.

(57) ABSTRACT

There is disclosed a block piece for holding an optical workpiece, in particular a spectacle lens, for machining thereof, which block piece comprises a basic body which has an end face, against which the workpiece can be blocked by means of a temporarily deformable material, and a clamping face via which the workpiece blocked on the basic body can be fixed on a spindle of a machining machine. According to the invention, the basic body is injection-molded from plastic and is provided on its end face with at least two cut-outs for receiving the temporarily deformable material, said cut-outs being arranged on either side of an imaginary plane which contains the central axis of the basic body, and the boundary face of said cut-outs which is closest to the central axis of the basic body in each case forms an undercut. As a result, a block piece of simple and very cost-effective design is provided, against which block piece the workpiece can be fixed in a reliable manner by means of the temporarily deformable material and in such a way that the workpiece remains on the block piece durably without play.

15 Claims, 4 Drawing Sheets

BLOCK PIECE FOR HOLDING AN OPTICAL WORKPIECE, IN PARTICULAR A SPECTACLE LENS, FOR MACHINING THEREOF

TECHNICAL FIELD

The present invention relates to a block piece for holding an optical workpiece for machining thereof. In particular, the invention relates to a block piece for holding a spectacle lens for machining thereof, as used in prescription workshops in masses, that is to say production workshops for manufacturing individual spectacle lenses from customary materials (polycarbonate, mineral glass, CR 39, HI index, etc.) according to a prescription.

PRIOR ART

In prescription workshops, the following process steps are usually carried out: Firstly, a suitable right and/or left spectacle lens blank is removed from a semifinished product store. The term semifinished is used to mean that the spectacle lens blanks, which are usually round or oval in plan view and have not yet been edged, have already been machined on one of their two optically active faces. The spectacle lens blanks are then prepared for the blocking operation, namely by applying a suitable protective film or a suitable protective lacquer to protect the optically active face which has already been machined. The so-called "blocking" of the spectacle lens blanks then takes place. During this, the spectacle lens blank is joined to a suitable block piece, for example a block piece according to German standard DIN 58766. To this end, the block piece is firstly brought into a predefined position with respect to the protected, already machined face of the spectacle lens blank, and then in this position the space between block piece and spectacle lens blank is filled with a molten material (wood metal or wax). Once the filler material has solidified, the block piece forms a holder for machining the spectacle lens blank. Only then can the spectacle lens blanks be machined by grinding, milling or turning, depending on the material, wherein the optically active face of the respective spectacle lens blank which has not yet been machined is given its macrogeometry according to the prescription. Fine machining of the spectacle lenses then takes place, in which the pre-machined optically active face of the respective spectacle lens is given the desired microgeometry. Depending on inter alia the material of the spectacle lenses, the fine machining process is divided into a fine grinding operation and a subsequent polishing operation, or includes only a polishing operation if a polishable face has already been produced during the pre-machining stage. Only after the polishing operation is the spectacle lens separated from the block piece before cleaning steps and possibly further refining steps are carried out, e.g. anti-reflection coating or hard coating of the spectacle lenses. The block piece accordingly remains on the spectacle lens for a number of machining operations and must remain reliably thereon during said operations.

FIGS. 11 to 14 show a previously known block piece 10 which is designed according to German standard DIN 58766. The block piece 10 has an annular basic body 12 which is made of steel or an aluminum alloy. Starting from a flat, annular face 14, against which the spectacle lens (not shown) can be blocked by means of the temporarily deformable material (not shown), the basic body 12 has on its outer circumference a cylindrical clamping face 16 via which the spectacle lens blocked onto the basic body 12 can be fixed on a spindle (not shown) of a machining machine. Adjoining the clamping face 16 is a conical centring face 18 which tapers towards a flat annular face 20 on the underside of the basic body 12.

The basic body 12 furthermore has a central through-hole 22 which can be divided into three longitudinal sections. Starting from the end face 14, the through-hole 22 has firstly a first conical face 24 which tapers in the direction of the lower annular face 20. Adjoining the first conical face 24 is a second conical face 26 which expands in the direction of the lower annular face 20 so that the second conical face 26 forms an annular undercut on the basic body 12 when seen from the end face 14. The second conical face 26 finally merges via a flat annular shoulder 28 into a third conical face 30 which is considerably longer than the first and second conical faces 24, 26 and likewise expands towards the lower annular face 20.

Starting from the lower annular face 20, the basic body 12 is furthermore provided with two cut-outs 32 which are diametrically opposed with respect to the central axis M and extend in the longitudinal direction of the basic body 12 essentially over the entire length of the centring face 18, said cut-outs being essentially V-shaped when seen in a side view as shown in FIG. 12 and serving to center the block piece 10 with respect to the central axis of the spindle (not shown) of the machining machine. Furthermore, starting from the lower annular face 20, a further cut-out 34 with parallel side walls is formed in the basic body 12, said cut-out 34 being offset at an angle with respect to the cut-outs 32 and serving for angle orientation of the block piece 10, that is to say ensuring that the block piece 10 is clamped on the spindle of the machining machine in a manner not wrongly rotated by 180°. Finally, two blind holes 36 parallel to the central axis M are formed in the annular shoulder 28 on diametrically opposite sides of the basic body 12 with respect to the central axis M.

In the blocked state of the spectacle lens (not shown), the meltable material fills the through-hole 22 at least in the region of the first and second conical faces 24, 26 and the blind holes 36 in the basic body 12. Consequently, the spectacle lens is held in a form-fitting manner on the block piece 10, wherein the meltable material engages behind the second conical face 26, in order to hold the spectacle lens in the axial direction against the block piece 10, and engages in the blind holes 36 in order to secure the spectacle lens against being twisted with respect to the block piece 10.

However, one disadvantage of this fixing of the spectacle lens on the block piece 10 may be regarded as being the fact that a certain movement play may arise between the spectacle lens and the block piece 10 on account of a slight shrinkage of the meltable material as it cools following the blocking operation, and this movement play adversely affects the machining accuracy. More specifically, the meltable material shrinks slightly in the region of the first and second conical faces 24, 26 in the direction of the central axis M of the basic body 12, so that a small annular gap may arise between the outer circumference of the meltable material and the first and second conical faces 24, 26. At the same time, the protrusions on the meltable material which engage in the blind holes 36 shrink slightly into themselves and, with the shrinkage of the meltable material in the region of the first and second conical faces 24, 26 of the through-hole 22, also move slightly inwards. As a result, an essentially linear pressing of each of the protrusions of the meltable material which engage in the blind holes 36 with a surface section of the respective blind hole 36 which lies radially inwards with respect to the central axis M of the basic body 12 may occur. If external forces directed in particular in the circumferential direction and radially inwards are superposed on these constraining forces in the essentially linear bearing region lying parallel to the central axis M of the basic body 12, between the respective protrusion of the meltable material and the radially inward-lying surface section of the associated blind hole 36, during the machining of the blocked spectacle lens, plastic deformation of the meltable material may occur at these bearing regions, and this ultimately leads to the abovementioned certain amount of movement play between the spectacle lens and the block piece 10.

OBJECT OF THE INVENTION

It is an object of the invention to provide a block piece of simple design for holding an optical workpiece, in particular a spectacle lens, for machining thereof, against which block piece the optical workpiece can be fixed in as reliable a manner as possible by means of the temporarily deformable material and in such a way that the optical workpiece remains on the block piece durably without play.

SUMMARY OF THE INVENTION

According to the present invention, there is provided a block piece for holding an optical workpiece for machining thereof, comprising a basic body which has a central axis and an end face, against which the workpiece can be blocked by means of a temporarily deformable material, and a clamping face via which the workpiece blocked on the basic body can be fixed on a spindle of a machining machine; wherein the basic body is injection-molded from plastic and is provided on its end face with at least two cut-outs for receiving the temporarily deformable material, said cut-outs being arranged on either side of an imaginary plane which contains the central axis of the basic body, and there being an inner boundary face of said cut-outs which is closest to the central axis of the basic body which in each case forms an undercut.

In other words, the undercut boundary faces of the cut-outs for receiving the temporarily deformable material lie radially inwards on opposite sides of the imaginary plane with respect to the central axis of the basic body. By virtue of this arrangement of the undercut boundary faces, unlike in the abovementioned prior art, no gap is formed between the respective undercut boundary face and the adjoining temporarily deformable material in the event of shrinkage of the temporarily deformable material in the direction of the central axis of the basic body. Quite the opposite—the temporarily deformable material, in the event of shrinkage thereof in the direction of the central axis of the basic body, is pulled against the undercut boundary face of each cut-out for receiving the temporarily deformable material, in the manner of a self-reinforcing solution, wherein the undercut boundary face of the respective other cut-out acts as an abutment. As a result of the position of the undercut boundary faces and the angular position thereof with respect to the end face of the basic body, the temporarily deformable material is also pulled against the end face of the basic body, so that any axial relative movement between the temporarily deformable material and the basic body is prevented. At the same time, a frictional connection is produced between the temporarily deformable material and the undercut boundary faces of the cut-outs for receiving the temporarily deformable material and the end face of the basic body, which frictional connection counteracts an undesirable relative movement of the temporarily deformable material with respect to the basic body. Moreover, simply on account of the fact that at least two cut-outs for receiving the temporarily deformable material are provided, no rotation-symmetrical engagement structures are present and there is also a form-fitting fixing of the temporarily deformable material against twisting relative to the basic body, without additional measures having to be provided for this, such as the provision of the blind holes 36 in the generic prior art.

Furthermore, since the basic body is injection-molded from plastic, the cut-outs for receiving the temporarily deformable material which have the undercut boundary faces may be formed in a simple manner with the aid of cross-slides in the injection-molding die, so that, unlike in the prior art, no complex machining of the basic body is required. Moreover, the use of plastic as the material for the basic body advantageously allows the use of liquid solvents and cleaning agents for the block piece, which up to now could not be used because they would have attacked the metallic material of the previously known block piece basic body. Last but not least, the use of plastic as the material for the basic body also has the advantage that the block piece has a low weight, so that there are lower moving masses on the workpiece side during machining of the blocked optical workpiece compared to the generic prior art. Overall, a block piece which can be produced in an extremely cost-effective manner is provided, which in particular causes no problems in terms of the fixed seating of the temporarily deformable material and thus of the blocked optical workpiece on the block piece.

In one preferred embodiment of the block piece according to the invention, the inner boundary face of the respective cut-out for receiving the temporarily deformable material, in each case closest to the central axis of the basic body, is essentially flat and extends at a distance from the central axis of the basic body more or less over the entire width of the end face of the basic body. A slit-like design of the cut-outs for receiving the temporarily deformable material is thus produced, which is particularly advantageous since the cut-outs designed in this way, unlike the blind holes 36 according to the generic prior art (cf. FIGS. 11 and 12), can be cleaned particularly well by means of a brush for example, in order to remove any residues of the temporarily deformable material once the optical workpiece has been removed from the block and thus to prepare the block piece for its next use.

It may furthermore be provided that the outer boundary face of the respective cut-out for receiving the temporarily deformable material, opposite the inner boundary face, is curved away from the inner boundary face, so that the respective cut-out opens radially outwards in the manner of a pocket. The temporarily deformable material can thus easily flow into the respective cut-out from outside during the blocking operation. Moreover, this design also provides a good possibility for cleaning the cut-outs for receiving the temporarily deformable material.

Continuing the concept of the invention, the inner boundary face may be connected to the outer boundary face of the respective cut-out for receiving the temporarily deformable material via just one curved connecting face, so that the respective cut-out at its longitudinal ends advantageously runs in a stepless manner into the end face of the basic body. Unlike the blind holes 36 in the generic prior art, the respective cut-out therefore does not form here any step or corner which can be cleaned only with difficulty by means of a brush for example.

The number of cut-outs for receiving the temporarily deformable material may also be more than two, although it should nevertheless be taken into account that both the manufacturing complexity for the block piece and the cleaning complexity increase as the number of cut-outs increases. For instance, the basic body may be provided on its end face with three cut-outs for receiving the temporarily deformable material, which cut-outs are placed in a symmetrical arrangement about the central axis of the basic body so that the radially inner boundary faces of the cut-outs form the shape of an equilateral triangle when seen in a plan view of the end face. However, preference is given to a design of the block piece in which the basic body is provided on its end face with four cut-outs for receiving the temporarily deformable material, which cut-outs are arranged in a symmetrical arrangement about the central axis of the basic body so that the inner boundary faces of the cut-outs, which inner boundary faces form the undercuts, form the shape of a square when seen in a plan view of the basic body. In the case of such an arrangement of four cut-outs, compared to a triangular arrangement of three cut-outs, the usable free surface between the cut-outs is advantageously greater. Moreover, with the square-shaped arrangement of the cut-outs, superposed on the frictional connection between the basic body and the temporarily deformable material, which is brought about by a pair of parallel cut-outs as described above and counteracts a transverse movement of the temporarily deformable material with respect to the basic body in the longitudinal direction, is a form fit which is brought about by the other pair of parallel cut-outs in the longitudinal direction of the first pair, so that any transverse movement of the temporarily deformable material relative to the basic body is reliably suppressed even under considerable external forces acting on the blocked workpiece during machining thereof.

In principle, the basic body of the block piece according to the invention may be provided, as in the generic prior art, with a central through-hole if for example the device used for blocking requires this since the temporarily deformable material is to be fed through the block piece and into the joining area between block piece and workpiece. However, preference is given to a "closed" design of the block piece, in which the basic body is provided on its end face, between the cut-outs for receiving the temporarily deformable material, with a spherical depression essentially in the center of said end face, so that the blocked optical workpiece, during machining thereof, is also supported by the block piece in a central region which is often critical. Compared to a block piece which in a likewise conceivable manner has a continuously flat end face, in this case an optical workpiece with a convex face on the block piece side is located closer to the block piece in the blocked state on account of the spherical depression in the basic body end face, so that the machining assembly consisting of the temporarily deformable material and the block piece is advantageously of relatively short design. The closer the workpiece is to the block piece, the less problems can occur on account of unbalances during the floating mounting of the workpiece by means of the block piece, and this in turn helps to achieve a high machining accuracy.

Furthermore, the basic body may be provided on its clamping face with at least two preferably conical hollows which are diametrically opposed with respect to the central axis of the basic body. These hollows, which may likewise be formed in a simple manner by providing suitable cross-slides in the injection-molding die during injection-molding of the basic body, serve for better automated handling of the blocked workpiece. More specifically, in this embodiment of the block piece, a parallel gripper of a handling device can engage with centring pins in the hollows in order to pick up the block piece at a predefined location, to transport it a certain distance and to place it back down at a predefined location.

Furthermore, the block piece in accordance with German DIN 58766 may be provided with two cut-outs for centring the block piece on the spindle of the machining machine, said cut-outs starting from a lower annular face of the basic body and being diametrically opposed from one another with respect to the central axis of the basic body and being essentially V-shaped in a side view of the basic body, wherein the cut-outs are advantageously formed during the injection-molding of the basic body by providing complementary protrusions in the injection-molding die, without complex machining of the basic body being required for this. In this case, starting from the base of each cut-out for centring the block piece, a blind hole may be formed in the basic body—which advantageously likewise takes place during the injection-molding of the basic body—with a metal bearing insert which has a ball socket or the like being inserted into said blind hole, so that the block piece can also be picked up at machining machines which grip the bearing inserts with pins in order to bring about a tilting movement of the block piece about an axis defined by the bearing inserts (cf. for example DE 40 00 291 A1).

Moreover, the block piece may be provided with at least one cut-out for rotation angle orientation of the block piece about the central axis, said cut-out starting from a lower annular face of the basic body, as known for example from the German standard DIN 58766, with the special feature that this cut-out is also formed during the injection-molding of the basic body by providing a suitable protrusion in the injection-molding die, so that complex machining of the cut-out on the basic body, as provided in the generic prior art, is advantageously omitted.

Continuing the concept of the invention, the basic body may also have a cut-out into which a so-called "transponder" is inserted. Such a transponder is a semiconductor element for storing and transmitting information, said element being known per se in particular in preparing prescriptions for spectacle lenses. This may then be used to identify the block piece or the blocked workpiece, the current state of machining of the workpiece, etc. In the generic prior art, an integration of such transponders in the block piece is not possible on account of the screening effect of the metal material of the basic body. Advantageously, the cut-out for receiving the transponder, which cut-out starts from a lower annular face of the basic body, may also be formed during the injection-molding of the basic body in that the injection-molding die for the basic body is once again provided with a suitable protrusion at this point.

Finally, the basic body of the block piece may be made of a glass-fiber-reinforced polyamide. This plastic is characterized in particular by a high impact strength and hardness and also good temperature-resistance. By virtue of the glass-fiber reinforcement of the plastic, the clamping surface of the block piece, which is subjected in particular to high mechanical stress, also has a high abrasion resistance, so that additional measures for reducing wear, for example the placement of a possibly metallic reinforcement in the injection-molding die in the region of the clamping face of the basic body—as would in principle also be conceivable—are not required.

BRIEF DESCRIPTION OF THE DRAWINGS

Hereinbelow, the invention will be explained in more detail on the basis of a preferred example of embodiment and with reference to the appended drawings. In the drawings.

DESCRIPTION OF THE PREFERRED EMBODIMENT

Figure 9:
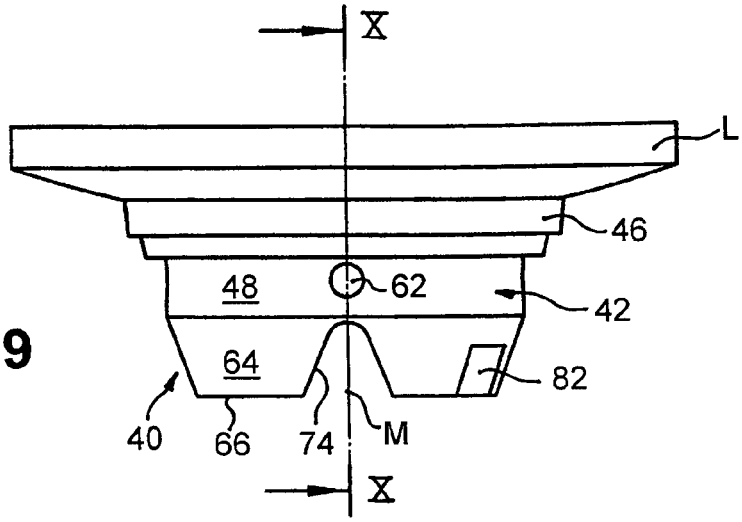
FIG. 9 shows a side view of the block piece of FIG. 1 on a smaller scale than FIG. 3 which almost corresponds to the actual size, with a spectacle lens as optical workpiece blocked thereon by means of a temporarily deformable material.
Figure 10:
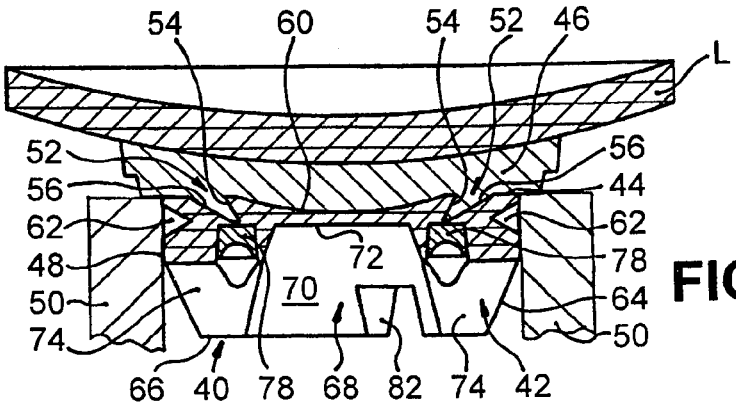
FIG. 10 shows a sectional view of the block piece and of the spectacle lens of FIG. 9 blocked thereon, along the section line X—X in FIG. 9, wherein it is also schematically shown how the block piece can be received on a spindle of a machining machine by means of collet chucks.
Figure 11:
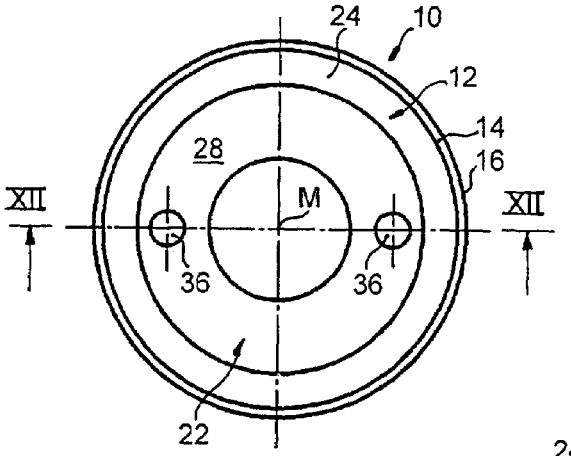
FIG. 11 PRIOR ART
FIG. 11 shows a plan view of a block piece according to the prior art, said plan view being on a somewhat larger scale than the actual size.
Figure 12:
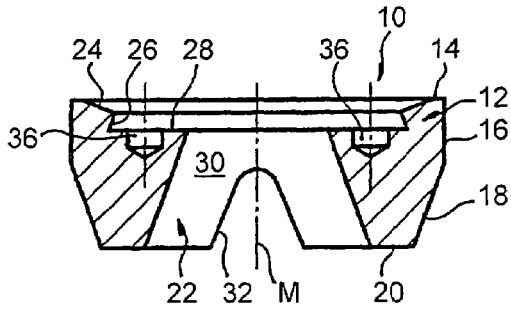
FIG. 12 PRIOR ART
FIG. 12 shows a sectional view of the previously known block piece of FIG. 11 along the section line XII-XII in FIG. 11.
Figure 13:
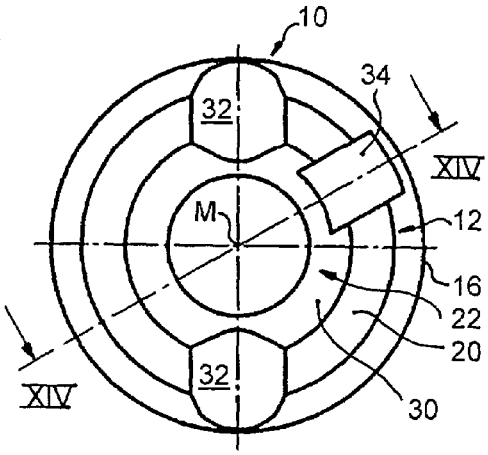
FIG. 13 PRIOR ART
FIG. 13 shows a view from below of the previously known block piece of FIG. 11 on the scale of FIG. 11.
Figure 14:
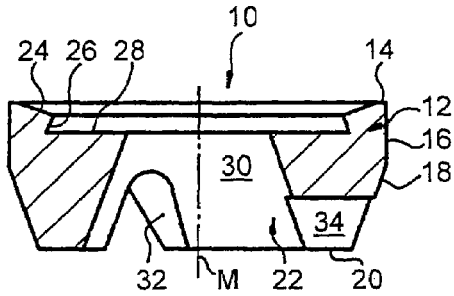
FIG. 14 PRIOR ART
FIG. 14 shows a sectional view of the previously known block piece of FIG. 11 along the section line XIV—XIV in FIG. 13.

FIGS. 1 to 7 show a reusable block piece 40 for holding an optical workpiece, in particular a spectacle lens L (cf. FIGS. 9 and 10), for machining thereof, which block piece comprises a basic body 42 which has an end face 44, against which the spectacle lens L can be blocked by means of a temporarily deformable material 46 (e.g. wax or a Wood's metal, also referred to as an alloy), as shown in particular in FIG. 10. The basic body 42 furthermore has a clamping face 48 via which the spectacle lens L blocked on the basic body 42 can be fixed on a spindle of a machining machine, collet chucks 50 of which are shown schematically in FIG. 10. It is essential that, as will be described in more detail below, the basic body 42 is injection-molded from plastic and is provided on its end face 44 with at least two cut-outs 52 for receiving the temporarily deformable material 46, said cut-outs being arranged on either side of an imaginary plane which contains the central axis M of the basic body 42, and the boundary face 54 of said cut-outs which is closest to the central axis M of the basic body 42 in each case, that is to say the radially inner boundary face 54, forms an undercut which is engaged behind by the temporarily deformable material 46 in the blocked state of the spectacle lens L, as can clearly be seen in particular from FIG. 10.

Figure 1:
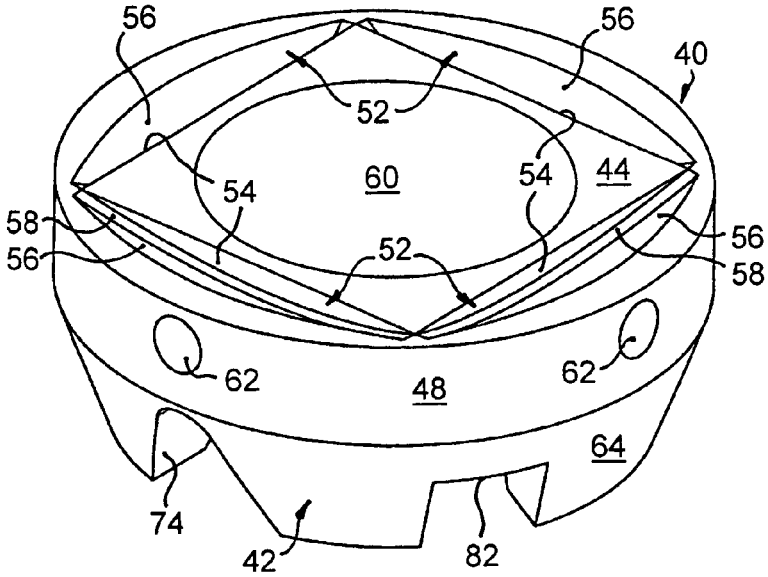
FIG. 1 shows a perspective view of a block piece according to the invention obliquely from the front/top, which is shown on an enlarged scale compared to the actual size.
Figure 3:
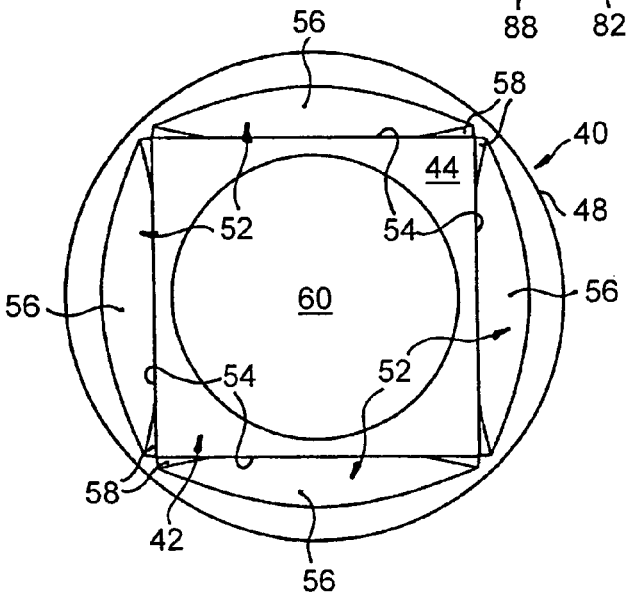
FIG. 3 shows a plan view of the block piece of FIG. 1 on a slightly smaller scale, which is nevertheless still on an enlarged scale compared to the actual size of the block piece.
Figure 4:
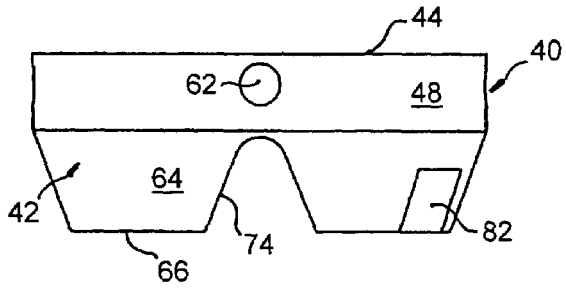
FIG. 4 shows a side view of the block piece of FIG. 1 on the scale of FIG. 3.

As can be seen in particular from FIGS. 4, 6, 7 and 8, the end face 44 of the essentially pot-shaped basic body 42, which basic body is made of a glass-fiber-reinforced polyamide, such as PA 6.6-GF30, is a flat face on which or starting from which four cut-outs 52 for receiving the temporarily deformable material 46 are provided in the example of embodiment, which cut-outs, as shown by FIGS. 1 and 3, are arranged in a symmetrical arrangement about the central axis M of the basic body 12. Here, the inner boundary face 54 of each cut-out 52 is flat and extends at a distance from the central axis M of the basic body 42 more or less over the entire width of the end face 44 of the basic body 42, as shown by FIGS. 1 and 3, so that the inner boundary faces 54 of the cut-outs 52 form the shape of a square in the plan view shown in FIG. 3.

It can furthermore be seen in FIGS. 1 and 3 that the radially outer boundary face 56 of the respective cut-out 52, opposite the inner boundary face 54, is curved outwards away from the inner boundary face 54 so that each cut-out 52 opens radially outwards in the manner of a pocket or mouth. As shown in particular in FIG. 1, the inner boundary face 54 of each cut-out 52 is connected to the outer boundary face 56 of said cut-out via just one curved connecting face 58, so that each of the slit-like cut-outs 52 at its longitudinal ends runs in a stepless manner towards the end face 44 of the basic body 42. Between the cut-outs 52, the basic body 42 is finally provided on its end face 44 with a spherical depression 60 essentially in the center of said end face.

Adjoining the end face 44 of the basic body 12 on the outer circumference side is the cylindrical clamping face 48 as a larger-diameter section of the block piece 40, which clamping face extends more or less over half the height of the block piece 40. On the clamping face 48, the basic body 42 is provided with at least two hollows 62 which are diametrically opposed with respect to the central axis M of the basic body 42, and in the illustrated example of embodiment with four hollows 62 which in a manner corresponding to the cut-outs 52 are offset at an angle of 90° with respect to the central axis M, said hollows having a conical shape in cross section (cf. FIGS. 6 and 10) and serving to allow handling or transport means (not shown) to grip the block piece 40. The hollows 62 are also preferably formed during the injection-molding of the basic body 42 with the aid of cross-slides in the injection-molding die, although this is not shown in FIG. 8 for the purpose of simplifying the diagram.

Adjoining the clamping face 48 is the conical centring face 64 (known per se) of the basic body 42, before the basic body 42 ends at the bottom with a flat annular face 66. On the inner circumference side, adjoining the lower annular face 66 is a central frustoconical blind hole 68, the conical face 70 of which tapers towards the flat bottom 72 of the blind hole 68.

As in the generic prior art, the block piece 40 is furthermore provided with two cut-outs 74 for centring the block piece 40 on the spindle of the machining machine in a manner known per se, said cut-outs starting from the lower annular face 66 of the basic body 42 and being diametrically opposed from one another with respect to the central axis M of the basic body 42 as shown in particular in FIGS. 2, 5, 8 and 10 and tapering essentially in a V-shaped manner towards the clamping face 48 in a side view (FIG. 4) of the basic body 42. It can also be seen in FIG. 4 that the cut-outs 74 extend more or less over the entire height of the conical centring face 64 and are axially aligned with the hollows 62 in the clamping face 48. The cut-outs 74 are also advantageously formed during the injection-molding of the basic body 42 by suitable protrusions in the injection-molding die.

Figure 6:
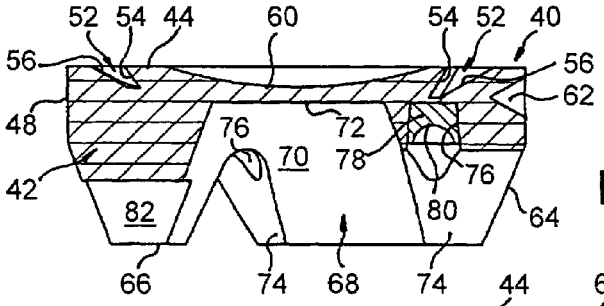
FIG. 6 shows a sectional view of the block piece of FIG. 1 along the section line VI—VI in FIG. 5.

As shown in particular in FIG. 6, starting from the base of each cut-out 74, a frustoconical blind hole 76 is formed in the basic body 42, with a metal bearing insert 78 being fixedly inserted, preferably glued, into said blind hole, said bearing insert having a ball socket 80 in the illustrated example of embodiment. The blind holes 76 are also formed during the injection-molding of the basic body 42. The optional bearing inserts 78 serve with their ball sockets 80 to receive spindle-side bearing pins (not shown) which are provided on certain machining machines (cf. for example DE 40 00 291 A1), and define a pivot axis about which a tilting movement of the block piece 40 is possible in these machining machines.

Furthermore, starting from the lower annular face 66, the basic body 42 is provided with a coding cut-out 82 for rotation angle orientation of the block piece 40 about the central axis M, as has already been explained with reference to FIGS. 11 to 14 relating to the generic prior art. In the illustrated example of embodiment, the block piece 40 as shown in particular in FIGS. 5 and 7 also has a second, cylindrical coding cut-out 84 which, starting from the lower annular face 66 of the basic body 42, extends into the latter parallel to the central axis M and serves for rotation angle orientation of the block piece 40 about the central axis M on a different type of machining machine. Both coding cut-outs 82, 84 are likewise formed during the injection-molding of the basic body 42 by suitable protrusions in the injection-molding die.

Figure 7:
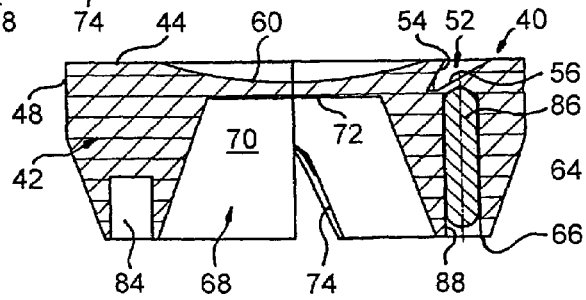
FIG. 7 shows a sectional view of the block piece of FIG. 1 along the section line VII—VII in FIG. 5.

In the illustrated example of embodiment, the block piece 40 is furthermore provided with a so-called "transponder" 86 for workpiece identification, which transponder is known per se and is shown only schematically in FIG. 7. In order to receive the transponder 86, the basic body 42 has a further, cylindrical cut-out 88 which, starting from the lower annular face 66 of the basic body 42, extends into the latter parallel to the central axis M thereof and as shown in FIG. 7 reaches almost as far as one of the cut-outs 52 for receiving the temporarily deformable material 46. This cut-out 88 is also preferably formed during the injection-molding of the basic body 42 by a suitable protrusion in the injection-molding die.

Figure 2:
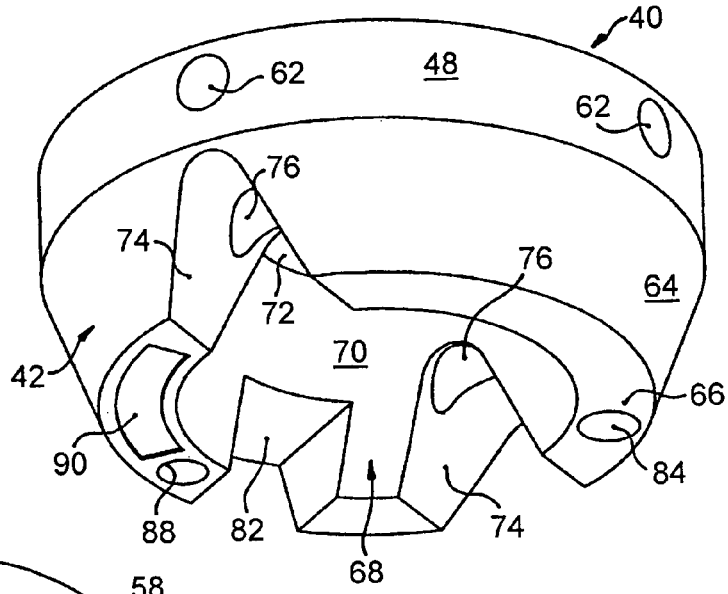
FIG. 2 shows a perspective view of the block piece of FIG. 1 obliquely from behind/below on the scale of FIG. 1.
Figure 5:
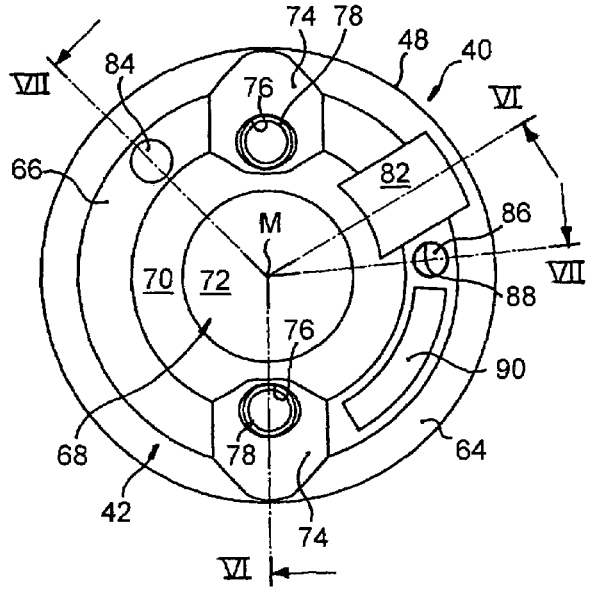
FIG. 5 shows a view from below of the block piece of FIG. 1 on the scale of FIG. 3.

Finally, the basic body 42 has in its lower annular face 66 as shown in FIGS. 2 and 5 also a depression 90 between one of the centring cut-outs 74 and the cut-out 88 for the transponder 86, which depression has the shape of a segment of a circle and is formed during the injection-molding of the basic body 42 and serves as a text field for an embossed ID or the like of the block piece 40.

Figure 8:
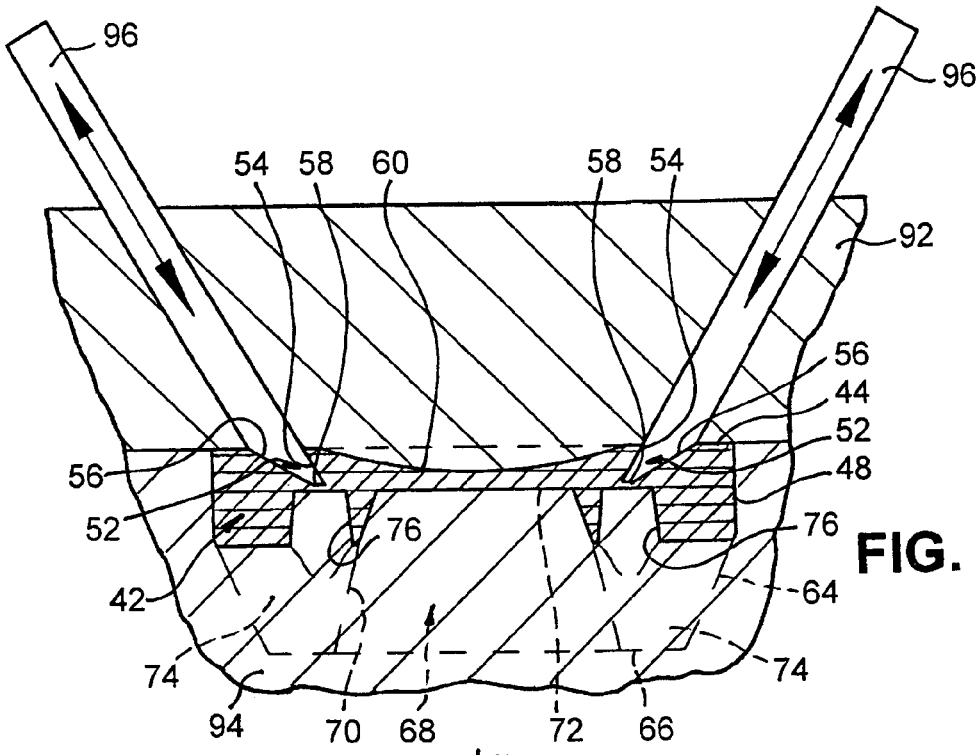
FIG. 8 shows a sectional view in principle of an injection-molding die for manufacturing a basic body for the block piece of FIG. 1, which shows how undercut cut-outs are formed in an end face of the basic body of the block piece by means of cross-slides in the injection-molding die.

FIG. 8 shows the two die halves 92, 94 of the injection-molding die for the basic body 42 of the block piece 40 in the closed state of the injection-molding die, with a basic body 42 which has already been injection-molded. Suitable profiled cross-slides 96 are schematically shown in the upper die half 92 of the injection-molding die, which cross-slides serve to form the undercut cut-outs 52 in the end face 44 of the basic body 42. The double arrows on the cross-slides 96 illustrate the movement possibilities of the cross-slides 96. To the person skilled in the art, it is obvious that the cross-slides 96 protrude into the cavity defined by the die halves 92, 94 in the injection-molding die during the injection-molding operation, in order to form the undercut cut-outs 52 in the end face 44 of the basic body 42, and once the plastic in the injection-molding die has solidified are pulled out of the cut-outs 52 formed on the basic body 42 so that the basic body 42 can be removed from the injection-molding die. The person skilled in the art will require no further explanation at this point as to how, besides the cut-outs 52 on the end face 44 of the basic body 42, all the other depressions, hollows, cut-outs, blind holes, etc. (60, 62, 74, 76, 82, 84, 88, 90) can also be formed in an extremely cost-effective manner in an injection-molding process by providing suitable protrusions (or further cross-slides for the hollows 62) in the injection-molding die.

With regard to the actual blocking operation, the result of which is shown in FIG. 9 and the process of which has been known for a long time to the person skilled in the art so that explanations in this respect are not required at this point, it should merely be pointed out that, in the described example of embodiment of the block piece 40, the temporarily deformable material 46 is fed radially from outside into the blocking device between the spectacle lens L and the block piece 40, in order to join these parts to one another. Here, on account of the pocket-like opening of the cut-outs 52 in the end face 44 of the basic body 42, the temporarily deformable material 46 easily flows into said basic body. On account of the described arrangement of the undercut faces 54, the shrinkage of the temporarily deformable material 46 then leads to a secure anchoring or adhesion of the temporarily deformable material 46 on the block piece 40.

In final summary, there is disclosed a block piece for holding an optical workpiece, in particular a spectacle lens, for machining thereof, which block piece comprises a basic body which has an end face, against which the workpiece can be blocked by means of a temporarily deformable material, and a clamping face via which the workpiece blocked on the basic body can be fixed on a spindle of a machining machine. According to the invention, the basic body is injection-molded from plastic and is provided on its end face with at least two cut-outs for receiving the temporarily deformable material, said cut-outs being arranged on either side of an imaginary plane which contains the central axis of the basic body, and the boundary face of said cut-outs which is closest to the central axis of the basic body in each case forms an undercut. As a result, a block piece of simple and very cost-effective design is provided, against which block piece the workpiece can be fixed in a reliable manner by means of the temporarily deformable material and in such a way that the workpiece remains on the block piece durably without play.

We claim:

1. Block piece for holding an optical workpiece for machining thereof, comprising a basic body which has a central axis and an end face, against which the workpiece can be blocked by means of a temporarily deformable material, and a clamping face via which the workpiece blocked on the basic body can be fixed on a spindle of a machining machine; wherein the basic body is injection-molded from plastic and is provided on its end face with at least two cut-outs for receiving the temporarily deformable material, said cut-outs being arranged on either side of an imaginary plane which contains the central axis of the basic body, and there being an inner boundary face of said cut-outs which is closest to the central axis of the basic body which in each case forms an undercut.

2. Block piece according to claim 1, wherein the inner boundary face of the respective cut-out for receiving the temporarily deformable material, in each case closest to the central axis of the basic body, is substantially flat and extends at a distance from the central axis of the basic body substantially over the entire width of the end face of the basic body.

3. Block piece according to claim 2, wherein each cut-out has an outer boundary face for receiving the temporarily deformable material, opposite the inner boundary face, the outer boundary face being curved away from the inner boundary face.

4. Block piece according to claim 3, wherein the inner boundary face is connected to the outer boundary face of the respective cut-out for receiving the temporarily deformable material via just one curved connecting face.

5. Block piece according claim 1, wherein the basic body is provided on its end face with four cut-outs for receiving the temporarily deformable material, which cut-outs are arranged in a symmetrical arrangement about the central axis of the basic body so that the inner boundary faces of the cut-outs, which inner boundary faces form the undercuts, form the shape of a square when seen in a plan view of the basic body.

6. Block piece according to claim 1, wherein the basic body is provided on its end face, between the cut-outs for receiving the temporarily deformable material, with a spherical depression substantially in the center of said end face.

7. Block piece according to claim 1, wherein the basic body is provided on its clamping face with at least two hollows which are diametrically opposed with respect to the central axis of the basic body.

8. Block piece according to claim 7, wherein said hollows are of conical form.

9. Block piece according to claim 1, wherein two cut-outs for centring the block piece on the spindle of the machining machine are formed during the injection-molding of the basic body, said cut-outs starting from a lower annular face of the basic body and being diametrically opposed from one another with respect to the central axis of the basic body and being substantially V-shaped in a side view of the basic body.

10. Block piece according to claim 9, wherein starting from the base of each cut-out for centring the block piece, a blind hole is formed in the basic body, with a metal bearing insert which has a ball socket being inserted into said blind hole.

11. Block piece according to claim 1, wherein at least one cut-out is formed during the injection-molding of the basic body for rotational orientation of the block piece about the central axis, said cut-out starting from a lower annular face of the basic body.

12. Block piece according to claim 1, wherein the basic body has a cut-out into which a transponder for identifying the optical workpiece is inserted.

13. Block piece according to claim 12, wherein the cut-out for receiving the transponder is formed during the injection-molding of the basic body, said cut-out starting from a lower annular face of the basic body.

14. Block piece according to claim 1, wherein the basic body is made of a glass-fiber-reinforced polyamide.

15. Block piece for holding a spectacle lens for machining thereof, comprising a basic body which has a central axis and an end face, against which the spectacle lens can be blocked by means of a temporarily deformable material, and a clamping face via which the spectacle lens blocked on the basic body can be fixed on a spindle of a machining machine; wherein the basic body is injection-molded from plastic and is provided on its end face with at least two cut-outs for receiving the temporarily deformable material, said cut-outs being arranged on either side of an imaginary plane which contains the central axis of the basic body, and there being an inner boundary face of said cut-outs which is closest to the central axis of the basic body which in each case forms an undercut.

* * * * *